US005819489A

United States Patent [19]

McKinney

[11] Patent Number: 5,819,489

[45] Date of Patent: Oct. 13, 1998

[54] PRE-FORMED BUILDING STUDS AND CONSTRUCTION FORM SYSTEM

[76] Inventor: John W. McKinney, 4886 Occoquan Club Dr., Woodbridge, Va. 22192

[21] Appl. No.: 870,700

[22] Filed: Jun. 9, 1997

Related U.S. Application Data

[60] Provisional application No. 60/019,564 Jun. 11, 1996.

[51] Int. Cl. [6] ..... E04B 2/30; E04B 2/40

[52] U.S. Cl. ..... 52/435; 52/309.11; 52/309.12; 52/425; 52/426; 52/427; 52/481.1

[58] Field of Search ..... 52/309.11, 309.12, 52/309.9, 309.16, 309.17, 415, 421, 424, 425, 426, 427, 434, 435, 729.2, 729.1, 729.4, 481.1, 742.14, 379

[56] References Cited

U.S. PATENT DOCUMENTS

| | | |
|---|---|---|
| 1,038,440 | 9/1912 | Robinson . |
| 2,276,040 | 3/1942 | Hull . |
| 2,382,201 | 8/1945 | Burke et al. . |
| 3,255,562 | 6/1966 | Altschuler . |
| 3,835,608 | 9/1974 | Johnson . |
| 4,525,974 | 7/1985 | Steidle-Sailer et al. . |
| 4,748,786 | 6/1988 | Hannah . |
| 4,843,777 | 7/1989 | Shimabukuro . |

FOREIGN PATENT DOCUMENTS

| | | |
|---|---|---|
| 80770 (B) | 7/1951 | Czechoslovakia . |
| 0013563 (A1) | 7/1980 | European Pat. Off. . |

*Primary Examiner*—Robert Canfield
*Attorney, Agent, or Firm*—Richard C. Litman

[57] ABSTRACT

Pre-formed building studs and a form utilizing such studs for receiving a flowable, hardenable material, for example cementitious material including concrete, for forming building structures such as foundations, walls, floors, roofs, etc. The studs allow passage of the cementitious material therethrough when poured into the form. The form comprises a hollow wall that includes two opposing form panels connected to preformed, flow-through studs, forming fluidly connected sections between each stud. As the cementitious material fills the hollow wall, each section is fluidly joined, allowing the cementitious material to harden and cure to form an integrated solid wall. Each stud includes two elongated parallel members having a flow-through web structure extending between the elongated members. By selecting form panels that are thermal insulators and waterproof, the resulting structure has improved moisture resistance and thermal insulation properties, both during and after the curing process.

6 Claims, 2 Drawing Sheets

PRE-FORMED BUILDING STUDS AND CONSTRUCTION FORM SYSTEM

CROSS-REFERENCE TO RELATED APPLICATION

This application claims the benefit of U.S. Provisional patent application Ser. No. 60/019,564, filed Jun. 11, 1996.

BACKGROUND OF THE INVENTION

1. Field of the Invention

The present invention is directed to a form for receiving a flowable, hardenable material, for example, cementitious material including concrete, to form building structures such as foundations, walls, floors, roofs, etc.

2. Description of the Related Art

It is common practice in the building industry, to form building structures by pouring a cementitious material into a previously formed mould. However, none of the related art is seen to show the unique structure of the pouring form of the present invention.

U.S. Pat. No. 1,038,440, issued to Roy H. Robinson on Sep. 10, 1912, shows a concrete filled composite frame structure. Robinson does not show form panels nailed to either side of a flow-through stud.

U.S. Pat. No. 2,276,040, issued to Alva M. Hull on Mar. 10, 1942, shows a metal structural frame into which nails can be driven. Hull does not show form panels nailed to either side of a flow-through stud.

U.S. Pat. No. 2,382,201, issued to Joseph R. Burke et al. on Aug. 14, 1945, shows a timber load bearing structural member. Burke et al. do not show form panels nailed to either side of a flow-through stud.

U.S. Pat. No. 3,255,562, issued to Robert L. Altschuler on Jun. 14, 1966, shows a plastic wall forming block system. Portions of the block system are filled with concrete to keep the structure from collapsing. Altschuler does not show form panels nailed to either side of a flow-through stud.

U.S. Pat. No. 3,835,608, issued to Bobby G. Johnson on Sep. 17, 1974, shows a fiberglass pour-in-place form for pouring concrete walls. Inside the form is a reinforcing grid formed by a plurality of square cross-section, vertical passages. Johnson does not show form panels nailed to either side of a flow-through stud.

U.S. Pat. No. 4,525,974, issued to Manfred Steidle-Sailer et al. on Jul. 2, 1985, shows a wooden beam composed of a lattice of bracing members extending between two parallel solid beams. Steidle-Sailer et al. do not show form panels nailed to either side of a flow-through stud.

U.S. Pat. No. 4,748,786, issued to William J. Hannah on Jun. 7, 1988, shows a steel joist composed of two elongated members having bracing members extending in a zigzag fashion between the elongated members. Hannah does not show form panels nailed to either side of a flow-through stud.

U.S. Pat. No. 4,843,777, issued to Yoshinobu Shimabukuro on Jul. 4, 1989, shows a wooden beam composed of bracing members extending between two parallel solid beams. Shimabukuro does not show form panels nailed to either side of a flow-through stud.

Czechoslovakian Patent Document Number 80770, dated July 1951, shows a variety of composite wooden beams. Czechoslovakian Patent Document '770 does not show form panels nailed to either side of a flow-through stud.

Canadian Patent Number 701,065, by Elict I. Snider dated Jan. 5, 1965, shows a load bearing wooden I-beam. Snider does not show form panels nailed to either side of a flow-through stud.

European Patent Application Number 13,563, by Sonny Bertilsson dated Jul. 23, 1980, shows a wooden beam having transverse struts extending between two elongated members. Bertilsson does not show form panels nailed to either side of a flow-through stud.

None of the above inventions and patents, taken either singly or in combination, is seen to describe the instant invention as claimed.

SUMMARY OF THE INVENTION

The present invention is directed to pre-formed building studs and a form utilizing such studs for receiving a flowable, hardenable material, for example cementitious material including concrete, to form building structures such as foundations, walls, floors, roofs, etc. The studs allow passage of the cementitious material therethrough when poured into the form of the present invention. The form comprises a hollow wall that includes two opposing form panels connected to preformed, flow-through studs, forming fluidly connected sections between each stud; as the cementitious material fills the hollow wall, each section is fluidly joined, allowing the cementitious material to harden and cure to form an integrated solid wall. Each stud includes two elongated parallel members having a flow-through web structure is extending between the elongated members. By selecting form panels that are thermal insulators and waterproof, the resulting structure can have improved moisture resistance and thermal insulation properties, both during and after the curing process.

Accordingly, it is a principal object of the invention to provide a form for receiving poured hardenable material to form building structures.

It is another object of the invention to provide a form for receiving poured hardenable material to form building structures, which form is quick and easy to erect.

It is a further object of the invention to provide a form for receiving poured hardenable material to form building structures, which form permits the controlled curing of the hardenable material to thereby improve compressive strength of the cured hardenable material.

Still another object of the invention is to provide a form for pouring concrete walls, which form becomes a structural part of the finished wall and which imparts improved water resistance and thermal insulation properties during the concrete curing process and to the finished wall.

It is yet a further object of the invention to utilize the herein described teachings to manufacture prefabricated building structural elements, such as pre-formed studs.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to a form, or a kit for constructing the form, for fabricating building structures such as walls, foundations, floors, and roofs using a hardenable material poured into the form. The hardenable material is initially in a flowable state and hardens to its final form after a period of time. The most commonly used hardenable materials are cementitious materials, an example of which is concrete. Once the form of the present invention is erected, the hardenable material is poured into the form and allowed to cure to form the finished structure. The form of the present invention becomes part of the finished structure, imparting desirable qualities, specifically including greater moisture resistance and better thermal insulating properties, to the wall both during and after completion of the curing process. In addition, the form system of the present invention is also advantageous in that it is easy to erect, requiring only standard framing tools. Furthermore, the form system gives improved compressive strength to the cured hardenable material because it allows controlled curing of the hardenable material when suitable insulative panels are chosen.

Figure 2:
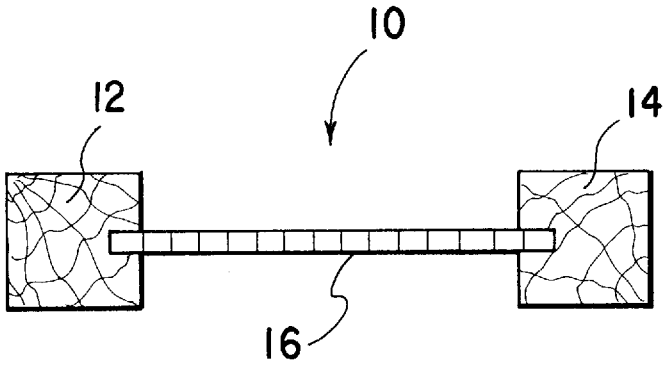
FIG. 2 is top view of a stud according to the present invention.
Figure 1:
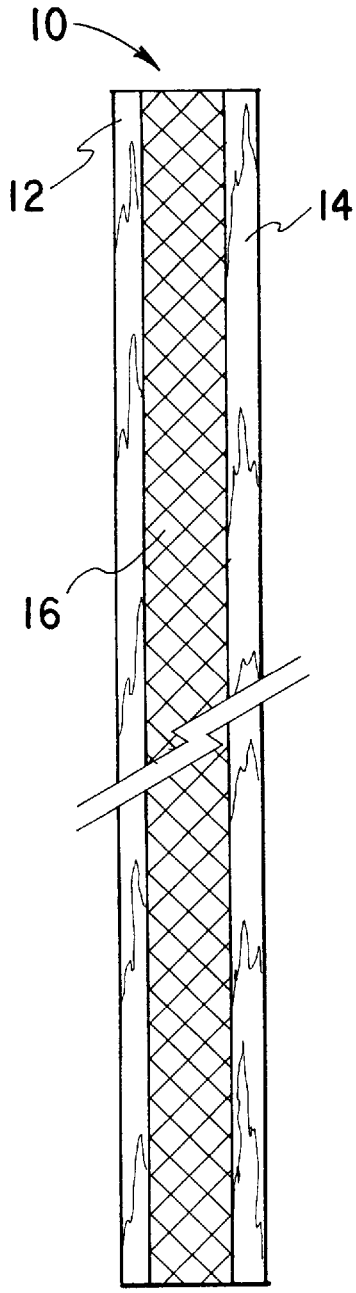
FIG. 1 is front view of a stud according to the present invention.

Referring to FIGS. 1 and 2, the form system of the present invention includes a plurality of studs 10. The stud 10 includes a first elongated member 12, a second elongated member 14, and a web 16. The elongated member 14 is spaced apart from and is parallel to the elongated member 12. A foraminous web 16 extends between the elongated members 12 and 14 and rigidly joins the elongated members 12,14 together.

The web 16 can be made of any rigid structure which allows the hardenable material, in the flowable state, to flow through the stud 10. The web 16 can be a lattice structure made of struts or braces extending between the elongated members 12 and 14, or the web 16 can be made of a mesh type material having a plurality of evenly distributed openings. Also, structural reinforcement members (e.g., rebar) may be used in combination with the mesh type material to add rigidity and strength to the stud 10. In other applications, the mesh material may be designed, configured and engineered to be used alone. The web 16 permits passage of the fluid concrete and results in a monolithic concrete wall with no voids or cavities to form within a form built of the studs and panels.

The web 16 can be attached to the elongated members 12 and 14 by any well known method. For example, the web 16 may be attached to the elongated members 12 and 14 by pressure application, glue, nails, or the elongated members 12 and 14 may be grooved and the web 16 mortised into the grooves. Alternatively, the elongated members, 12 and 14, and the web 16 may be assembled by fusing, gluing, etc. The elongated members 12 and 14 can be made of metal, plastic, recycled plastic, composites or wood, such as treated lumber, pressure treated lumber or laminated veneer lumber. This list is not exhaustive and other suitable materials may be used if desired.

Figure 3:
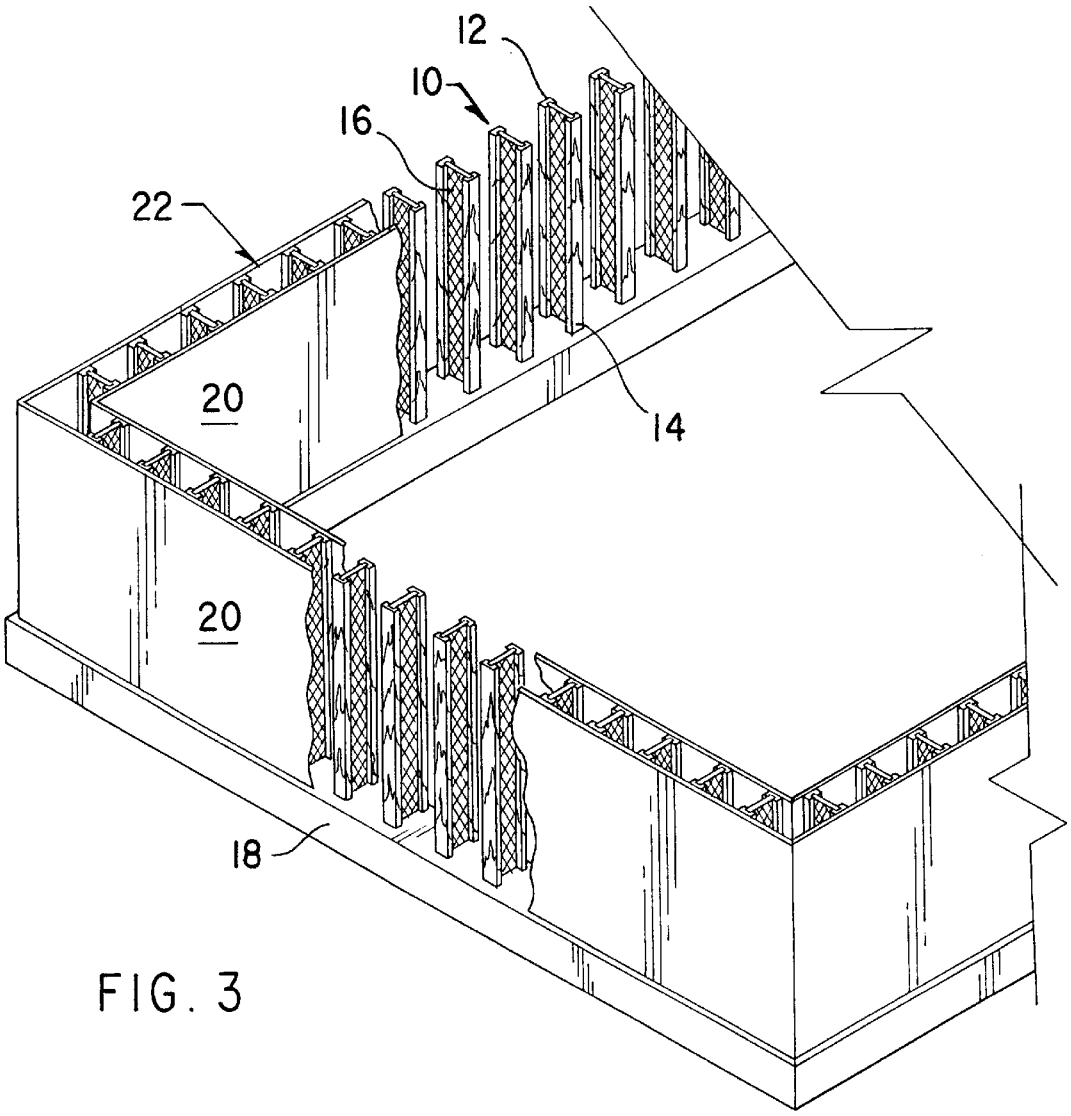
FIG. 3 is an environmental perspective showing a concrete pouring form made using the studs of the present invention.

Referring to FIG. 3, the form system of the present invention is shown erected over a concrete footing 18 to form the vertical wall of a building foundation. The form system further includes the panels 20 which are planar, rectangular pieces in the present example. Each stud 10 is positioned on the footing 18 such that it stands vertically on one end. The studs 10 are evenly distributed on top of the footing 18 such that they form a row of vertical studs, with the webbing 16 of each stud being in registry with the webbing of the other studs in the row. A plurality of insulated panels 20 are affixed by conventional fasteners (such as nails, screws, clips, etc.) to the elongated members 12 and 14 on either side of the row of studs. The hollow wall structure 22 thus formed is then filled with concrete. Once the concrete dries and sets, the studs 10 and the panels 20 become a permanent part of the finished wall. Thus a solid wall is formed that has improved moisture resistance and thermal insulation properties. An added advantage of such as system is that during curing of the concrete, the thermal insulation properties of suitably selected panels 20 improve the curing characteristics of the concrete. Moreover, upon curing, the form remains in place, thus eliminating time and labor otherwise associated with its removal.

Panels 20 chosen for insulating properties can be formed of any well known insulating structural sheathing. Examples of such structural sheathing include treated plywood, pressure treated plywood, expanded polystyrene, extruded polystyrene, and composites. As noted, insulated panels 20 allow controlled curing of the poured concrete which greatly adds strength and durability, and prevents hairline fractures from occurring in the concrete walls. The insulated panels 20 allow the concrete wall to be poured in extreme cold or hot weather without any adverse effects to the overall strength and durability of the finished product. The use of insulated panels 20 also reduces the heating and cooling costs of the building. The panels 20 also add a waterproof or moisture resistant quality to the concrete wall.

The present invention saves both time and labor. The studs 10 and panels 20 may be pre-fabricated to specific dimensions and shapes (e.g. window or door openings) which eliminates waste and saves time during the erection of the building structure. Furthermore, wiring and plumbing can easily be routed through the insulated structural sheathing. As noted, the present invention does not need to be stripped down and removed after the concrete cures, as with conventional methods. Additionally, the present invention does not require any additional strapping or framing to eliminate surface bows or waves. Carpentry crews can install the walls without the need for special tools or heavy equipment and without the need for special training to use those tools or equipment. The present invention eliminates the need for heavy metal concrete forms and replaces or reduces the use of expensive conventional lumber.

The studs 10 are manufactured straight and true which insures straight and plumb walls after assembly into the form. The panel 20 can accept any exterior and interior finish the builder desires. The panels 20 and studs 10 can be constructed of material capable of withstanding the elements and not edible to wood destroying insects.

It is to be understood that the present invention is not limited to the sole embodiment described above, but encompasses any and all embodiments within the scope of the following claims.

I claim:

1. A form system for fabricating building structures from a hardenable material, the material being hardenable from a flowable state after a time period, said form system comprising:

a first plurality of substantially solid panels being substantially planar and being arranged edge to edge to define a first planar surface;

a second plurality of substantially solid panels being substantially planar and being arranged edge to edge to define a second planar surface, said first surface being substantially parallel to and spaced apart from said second surface, said first planar surface and said second planar surface defining a space into which the hardenable material is to be poured; and a plurality of studs, each of said plurality of studs including:

a first elongated member, a second elongated member being spaced apart from and parallel to said first elongated member while being in registry with said first elongated member, and a foraminous web sheet of mesh material having a plurality of evenly distributed openings therethrough, said foraminous web sheet extending between and attached to said first elongated member and said second elongated member, said foraminous web allowing the hardenable material in the flowable state to flow therethrough, each of said plurality of studs being positioned in said space defined by said first and second plurality of panels with said first elongated member thereof abutting and being fixed to said first planar surface and said second elongated member thereof abutting and being fixed to said second planar surface.

2. The form system according to claim 1 wherein each of said plurality of studs extends between said first surface and said second surface and meets said first surface and said second surface at substantially right angles.

3. The form system according to claim 1 wherein said first elongated member and said second elongated member are made of a material selected from the group consisting of wood, metal, plastic, recycled plastic, and composites.

4. The form system according to claim 1 wherein said first plurality of panels and said second plurality of panels are constructed of thermal insulating material.

5. The form system according to claim 1 wherein said first plurality of panels and said second plurality of panels are constructed of waterproof material.

6. The form system according to claim 1 wherein said first plurality of panels and said second plurality of panels are made from a material selected from the group consisting of treated plywood, pressure treated plywood, expanded polystyrene, extruded polystyrene, and composites.

* * * * *